US006744001B2

(12) United States Patent
Dufournet et al.

(10) Patent No.: US 6,744,001 B2
(45) Date of Patent: Jun. 1, 2004

(54) HIGH-VOLTAGE CIRCUIT-BREAKER INCLUDING A VALVE FOR DECOMPRESSING A THERMAL BLAST CHAMBER

(75) Inventors: Denis Dufournet, Sathonay Camp (FR); Michel Perret, Tramole (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/385,543

(22) Filed: Mar. 12, 2003

(65) Prior Publication Data

US 2003/0173335 A1 Sep. 18, 2003

(30) Foreign Application Priority Data

Mar. 18, 2002 (FR) ..... 02 03305

(51) Int. Cl.[7] ..... H01H 33/88
(52) U.S. Cl. ..... 218/66; 218/63; 218/53
(58) Field of Search ..... 218/43–48, 51, 218/53, 54, 60–66, 57, 59, 72, 73, 88, 141

(56) References Cited

U.S. PATENT DOCUMENTS 4,327,262 A * 4/1982 Kull ..... 218/66
4,517,425 A 5/1985 Martin
5,723,840 A * 3/1998 Bojic et al. ..... 218/60
5,898,149 A * 4/1999 Berger et al. ..... 218/60
6,462,295 B1 * 10/2002 Knobloch et al. ..... 218/48

FOREIGN PATENT DOCUMENTS

EP 0 296 363 A 12/1988
FR 2 373 141 A 6/1978

* cited by examiner

*Primary Examiner*—Marina Fishman
(74) *Attorney, Agent, or Firm*—Sughrue Mion, PLLC

(57) ABSTRACT

A high-voltage circuit-breaker including a valve for decompressing a thermal blast chamber includes two contacts disposed in a breaking space which is delimited by a blast nozzle and contains a dielectric gas. It further includes a thermal blast chamber which communicates with the breaking space via a throat of the nozzle and with an expansion space via an evacuation passage which can be shut off by a valve. The valve opens when the pressure in the thermal blast chamber is greater than a particular threshold to evacuate the pressurized gas from the chamber. The evacuation passage is formed in the nozzle and defines a circular volume within the thickness of the nozzle, following its general shape, and opening into the expansion space downstream of the breaking space relative to the throat.

10 Claims, 4 Drawing Sheets

HIGH-VOLTAGE CIRCUIT-BREAKER INCLUDING A VALVE FOR DECOMPRESSING A THERMAL BLAST CHAMBER

BACKGROUND OF THE INVENTION

1. Field of the Invention

The invention relates to a circuit-breaker comprising two contacts disposed in a breaking space containing a dielectric gas and between which an electrical arc is established during an operation of opening the circuit-breaker, which includes a thermal blast chamber communicating with the breaking space.

2. Description of the Prior Art

The invention applies to a high-voltage circuit-breaker intended to break high currents and at the same time to minimize the duration of an electrical arc appearing between its contacts during the opening operation. In this context the expression "high current" refers to a current that has a high amplitude or continues to flow for a long time period. In this regard, the invention applies in particular to breaking low-frequency alternating currents, for example the currents flowing in railroad power supply networks which are supplied with power at a frequency of 16.66 Hz or 25 Hz, as in Germany and Switzerland, for example. With such low frequencies, the duration of the current wave is two to three times longer than for a frequency of 50 Hz, and the heat produced in the event of electrical arcing can therefore be two to three times greater than for a 50 Hz current.

To improve their breaking capacity, conventional circuit-breakers generally comprise a pneumatic self-blast device which blows dielectric gas in the direction of the arc at the time of opening to encourage breaking space of the arc. A self-blast device of this kind conventionally comprises a compression chamber including a piston coupled to a mobile contact of the circuit-breaker to move with it and adapted to blow a constant volume of cool gas in the direction of the breaking space during each opening. The piston is moved by the circuit-breaker actuation energy causing the movement of the mobile contact during opening. The greater the electrical arc current, the greater the pneumatic blast required. To break high currents, the dimensions of the piston compression chamber must be increased accordingly, necessitating consequential uprating of the circuit-breaker actuator system so that it is capable of supplying sufficient energy for the blast. Using an uprated actuator system generates a high overcost, which makes the price of this kind of circuit-breaker relatively uncompetitive.

One way to increase the blast to break high-current arcs is for a heating blower chamber to adjoin the pneumatic compression blower chamber. In the heating blower chamber, which is situated between the pneumatic blower chamber and the breaking space, for example, the dielectric gas is heated by the electrical arc and its pressure increases. The thermal blast chamber is shaped to encourage the flow of the gas that it contains toward the breaking space in the event of an increase in the pressure of the gas, with the result that the higher the arc current, the greater the blast. Nevertheless, in the case of a high-current electrical arc, the temperature in the thermal blast chamber can increase excessively, which reduces the dielectric strength of the gas that is blown into the breaking space and makes it impossible to break the current.

U.S. Pat. No. 4,517,425 discloses a circuit-breaker comprising a thermal blast chamber which communicates with a breaking space via the throat of a nozzle and with an expansion space through passages closed by valves. In one particular embodiment of the circuit-breaker, at least one of the valves is an evacuation valve adapted to open when the pressure in the thermal blast chamber is greater than a particular threshold to evacuate pressurized gas from the chamber to the expansion space.

This construction increases the breaking capacity because the valve opens to depressurize the chamber if the pressure in the thermal blast chamber becomes too high. This depressurization decreases the temperature, which guarantees that the gas blown into the breaking space has a satisfactory dielectric strength.

In the above prior art circuit-breaker, the passage shut off by the evacuation valve is in the base of the fixed contact and opens into one end of the breaking chamber. It is therefore necessary to provide a dedicated expansion volume adjoining the breaking chamber. The evacuation of the gases then does not contribute to the blowing of the hot gases and/or the arc into the divergent section of the nozzle. Furthermore, it is evident that this type of arrangement is not suited to an architecture in which a pneumatic blast chamber adjoins the thermal blast chamber.

The patent document EP 0296363 discloses a circuit-breaker with pneumatic and thermal blast chambers. The wall separating the two chambers is spring-loaded and incorporates an opening that is arranged with another opening in the cylindrical casing that delimits the perimeter of the pneumatic blast chamber so that the two openings constitute a valve for evacuating the pressurized gases coming from the thermal blast chamber.

The separator wall is adapted to compress the spring if the pressure in the thermal blast chamber is higher than that in the pneumatic blast chamber, so that the openings can be lined up to allow the pressurized gas to escape toward an expansion space around the cylindrical casing common to the pneumatic and thermal blast chambers. Note, however, that a device of this type cannot be applied to a circuit-breaker architecture in which permanent current contacts are disposed around blast chambers, i.e. in the expansion space for the hot pressurized gases. This is because, at the moment the arc contacts separate, the gas between the permanent current contacts would no longer have sufficient dielectric properties to prevent, arcing between the permanent current contacts, which are not designed to withstand arcing.

An object of the invention is to remedy the above drawbacks by proposing a circuit-breaker capable of breaking high currents thanks to a system for evacuating hot pressurized gases, without this necessitating excessive modifications to the architecture of a conventional circuit-breaker. In particular, the aim is to provide a device such that only a very small number of components need to be modified in a standard circuit-breaker not designed to withstand such high currents with equally long wave durations/periods (or equally low frequencies).

SUMMARY OF THE INVENTION

To this end, the invention proposes a circuit-breaker including two contacts disposed in a breaking space which is delimited by a blast nozzle and contains a dielectric gas, the circuit-breaker including a thermal blast chamber which communicates with the breaking space via a throat of the nozzle and with an expansion space via an evacuation passage adapted to be shut off by a valve, the valve being adapted to open when the, pressure in the thermal blast chamber is greater than a particular threshold to evacuate the pressurized gas from the chamber, which circuit-breaker is characterized in that the evacuation passage is formed in the nozzle and defines a circular volume within the thickness of the nozzle, following the general shape thereof, and opening into the expansion space downstream of the breaking space relative to the throat.

With this form of construction, the blowing of gas through the evacuation passage contributes to blowing the hot gases contained in the divergent section of the nozzle and therefore improves the regeneration of the dielectric strength in the breaking space after the arc is extinguished.

The nozzle can preferably also incorporate the valve and, to offset development and fabrication costs, can therefore be retrofitted to an existing circuit-breaker.

In another particular embodiment of the invention, the nozzle comprises two coaxial parts, its external part surrounding its internal part to leave a circular free space forming an evacuation passage for evacuating gas out of the thermal blast chamber, the valve being designed to shut off said evacuation passage. This makes the nozzle less costly to fabricate. The valve and an associated evacuation passage define a circular shape to reduce head losses. Thus the evacuation passage can accommodate a high flowrate to reduce the pressure rise in the thermal blast chamber as quickly as possible. The valve can advantageously have an annular shape and bear on one or more calibrated springs, so that it opens against the action of the spring(s). The valve opening threshold can therefore be altered merely by changing the calibrated spring(s).

In another particular embodiment of the invention, the circuit-breaker includes a piston compression chamber that communicates with the heating compression chamber. The gas blown into the breaking space is then a mixture of cool gas from the piston compression chamber and hotter gas from the thermal blast chamber, which reduces the temperature of the gas to maintain a high breaking capacity of the circuit-breaker.

The invention is described next in more detail and with reference to the accompanying drawings, which show one embodiment of the invention by way of non-limiting example.

DETAILED DESCRIPTION OF THE PREFERRED EMBODIMENT

Figure 1:
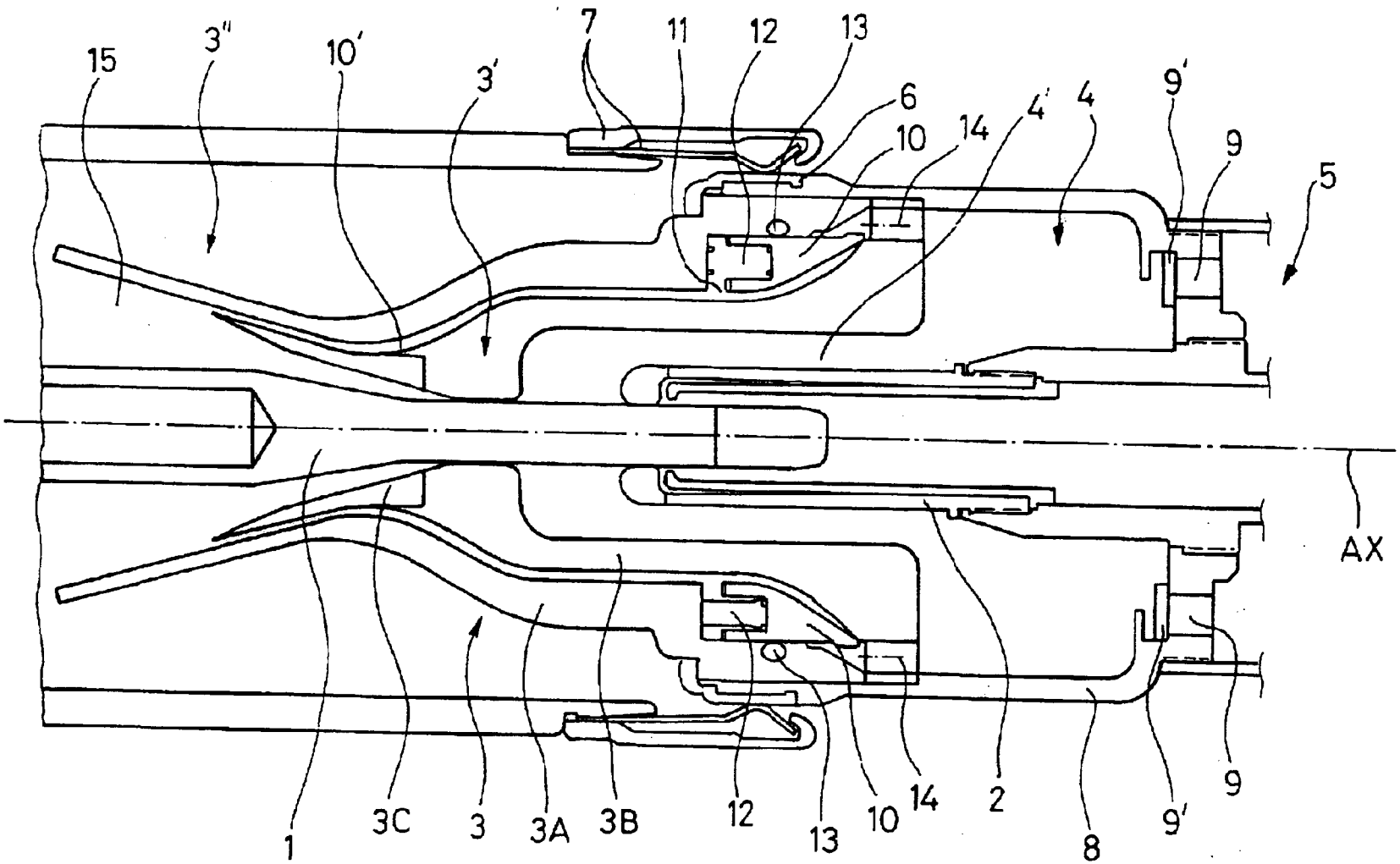
FIG. 1 is a first view in section of a circuit-breaker according to the invention, in a closed state.

FIG. 1 shows in diagrammatic axial section one example of a circuit-breaker in accordance with the invention. The circuit-breaker includes a fixed contact 1 forming a rod and a mobile contact 2 that is moved in an axial direction AX. The mobile contact 2 is hollow and is part of a mobile assembly including a circular blast nozzle 3 coaxial with the axis AX, a thermal blast chamber 4, and a piston compression chamber 5. The mobile assembly also includes a permanent contact 6 which cooperates with a substantially cylindrical fixed permanent contact 7 to close the circuit-breaker.

Figure 2:
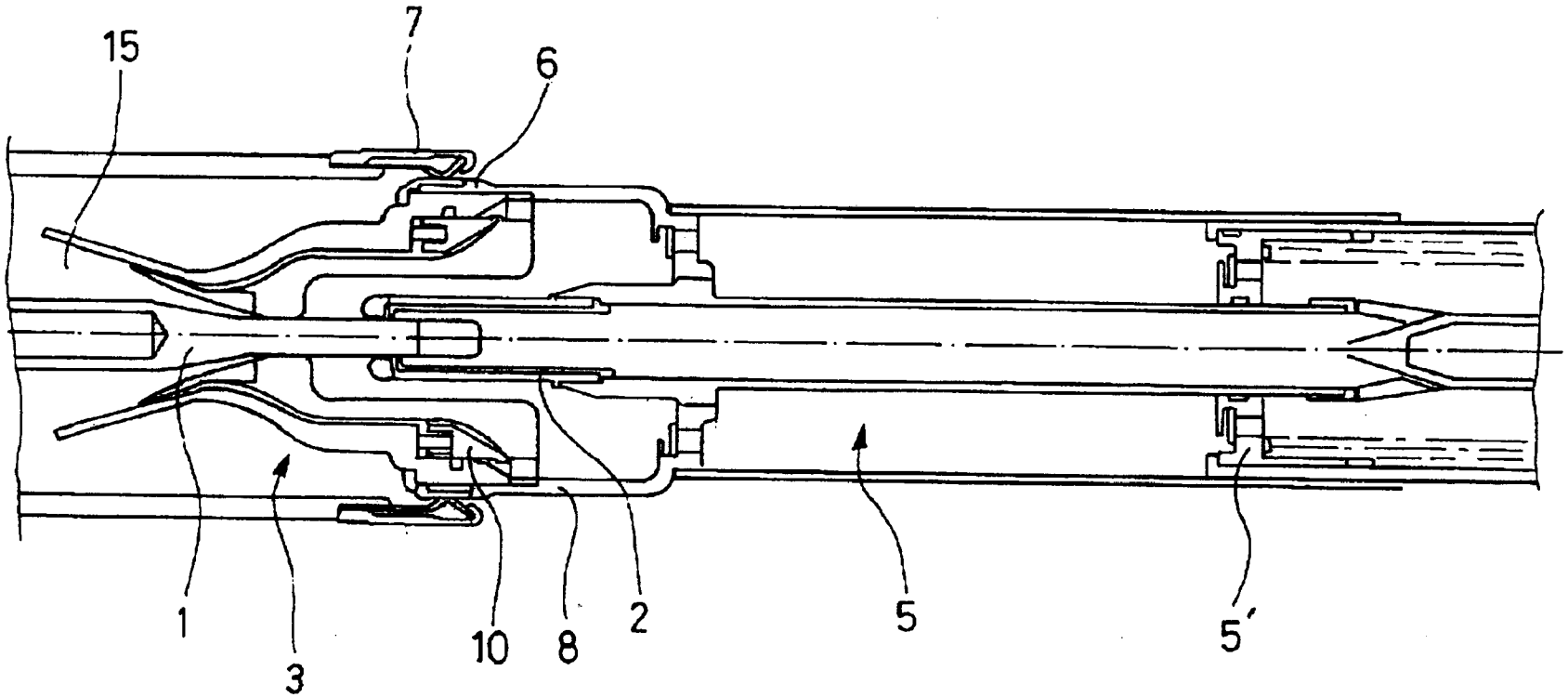
FIG. 2 is a second view in section of the circuit-breaker according to the invention, in a closed state.

The blast nozzle 3, which is made from an insulative material such as PTFE, has a small section throat 3' which widens to form a divergent section 3" downstream of the throat. When the circuit-breaker is closed, the contact 1 passes through the throat 3' of the nozzle 3 into the hollow contact 2 situated upstream of the throat along the axis AX, as can be seen in FIGS. 1 and 2. The throat and the divergent section of the nozzle 3 here define a space for breaking an electrical arc that is struck between the contacts 1 and 2 during the opening of the circuit-breaker. This space can be seen in FIGS. 3 and 4. This breaking space communicates with the heating blast blower chamber 4 through a circular passage 4' between the thermal blast chamber 4 and the breaking space.

The thermal blast chamber 4 defines an annular space coaxial with the axis AX and delimited by the mobile contact 2 and a casing 8 surrounding the mobile contact 2. The casing 8 is closed at one end by the blast nozzle 3. The dielectric gas contained in the thermal blast chamber 4 is pressurized when it is heated by contact with the electrical arc that is established between the contacts 1 and 2 at the moment of opening. As known to the person skilled in the art, this pressure rise produces a thermal blast of dielectric gas that travels from the thermal blast chamber 4 toward the breaking space. The thermal blast chamber 4 communicates with the piston compression chamber 5 through a plurality of passages 9. When the circuit-breaker opens, the dielectric gas contained in the chamber 5 is compressed and flows through the thermal blast chamber 4 into the breaking space. Simultaneously with the blast produced by the compression chamber 5, heating by the electrical arc increases the pressure in the thermal blast chamber to increase the flowrate of dielectric gas into the breaking space, as indicated above.

Figure 3:
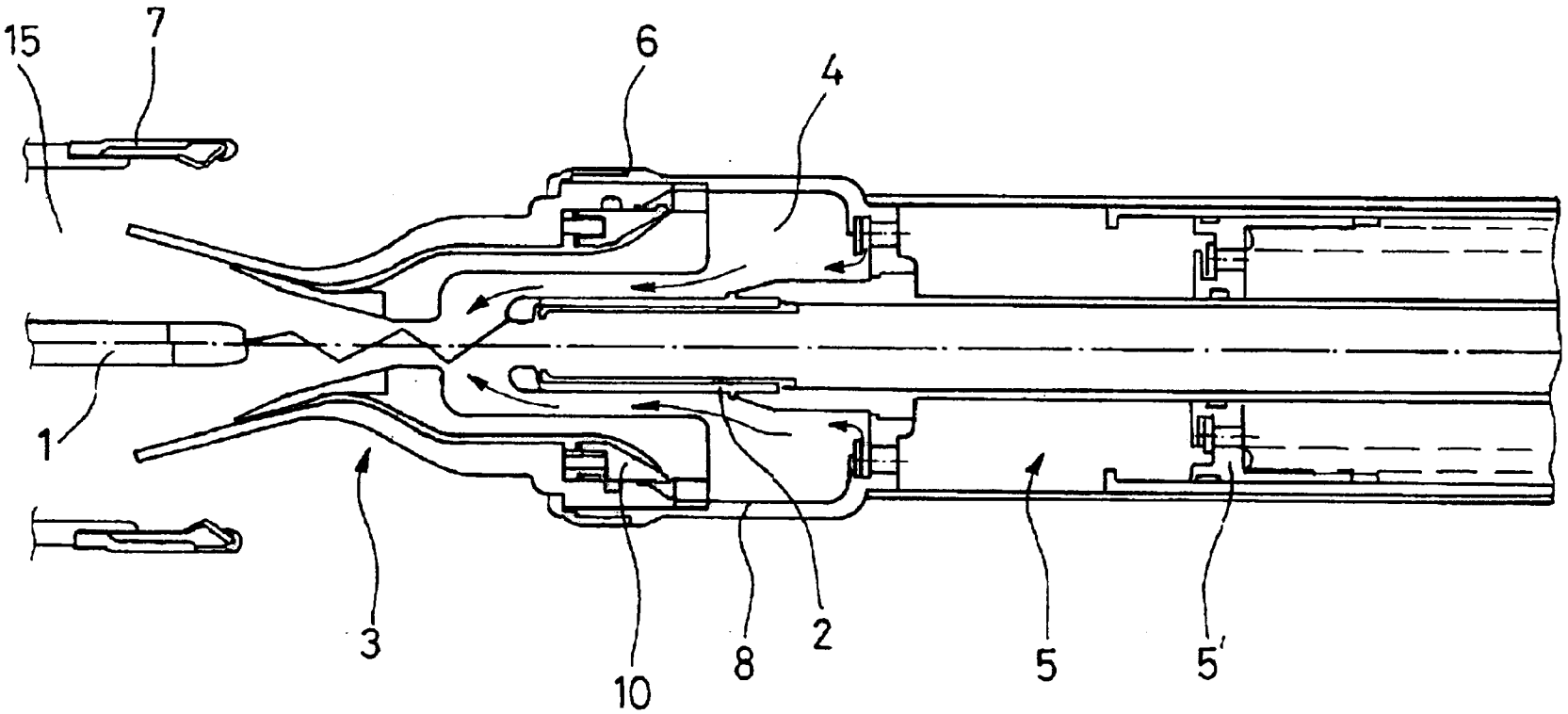
FIG. 3 is a view in section of the circuit-breaker when breaking a low current, with the valve closed.
Figure 4:
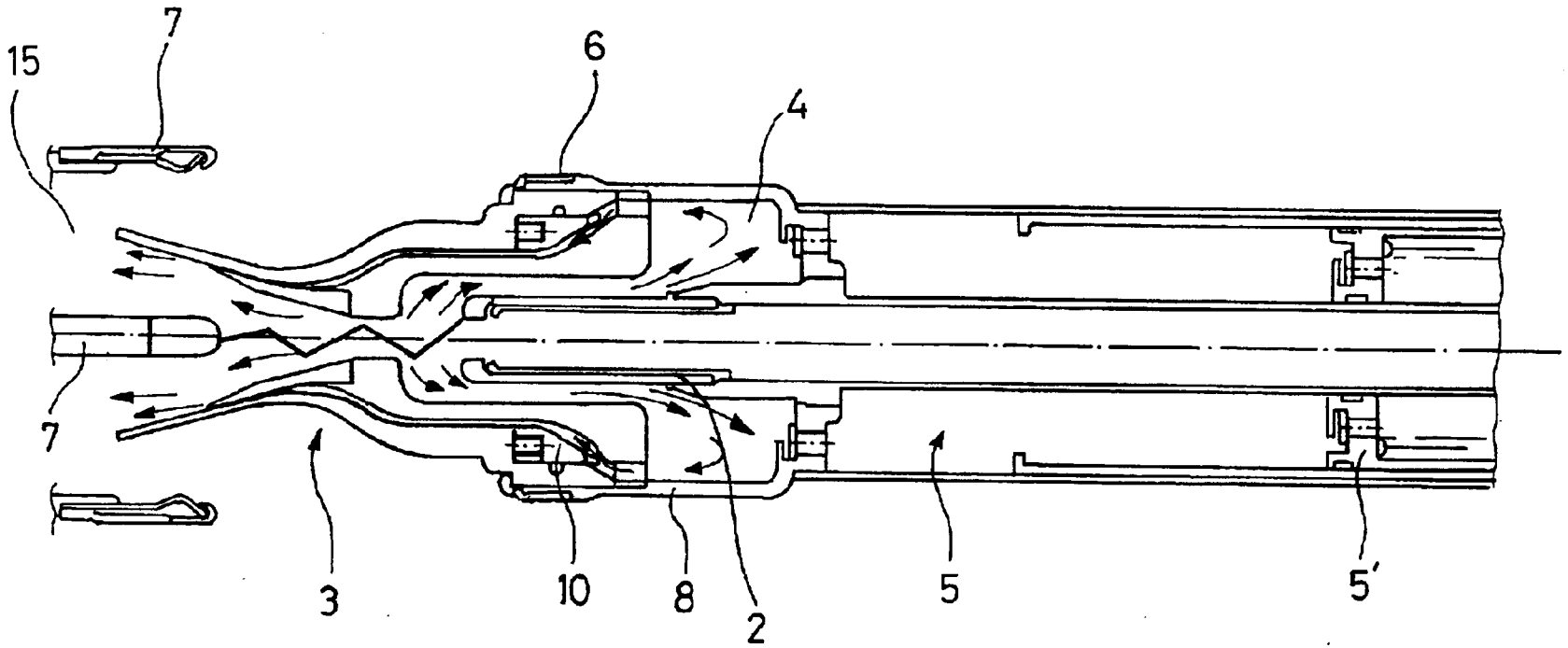
FIG. 4 is a view in section of the circuit-breaker when breaking a high current, with the valve open.

The thermal blast chamber 4 communicates through an evacuation passage 10' shut off by a valve 10 with an expansion space 15. This expansion space is downstream of the breaking space relative to the throat 3' of the nozzle, and is partly delimited by the divergent section 3" of the nozzle. When the pressure in the thermal blast chamber 4 is above a particular threshold the valve opens to evacuate the pressurized gas from the thermal blast chamber 4. To break low currents, the electrical arc increases the pressure in the thermal blast chamber without that pressure exceeding a predetermined threshold, and the valve therefore remains closed, as shown in FIG. 3. When breaking high electrical currents, which tends to increase excessively the temperature and therefore the pressure in the thermal blast chamber, the valve 10 opens to reduce the pressure in the thermal blast chamber, as shown in FIG. 4. This reduction in pressure is accompanied by a reduction in temperature, which guarantees that the dielectric gas blown into the breaking space has a satisfactory insulation capacity. The valve can be mounted on the casing 8, for example, to evacuate the pressurized gas directly to the exterior of the thermal blast chamber 4.

The valve 10 can advantageously be integrated into the blast nozzle 3 that caps the casing 8. Referring again to FIG. 1, it can be seen that the valve 10 is annular so that it can be mounted in the nozzle 3 on the same side as the thermal blast chamber 4. The valve, which is made of a rigid material, is mounted in a housing 11 of the nozzle defining an annular groove, and is spring-loaded by calibrated springs 12 that bear on the bottom of the groove defined by the housing 11. The valve is therefore able to move in translation along the axis AX, against the action of the springs 12, to open the valve. An annular seal 13 provides a seal between the external surface of the valve and the groove. The valve is fed through a plurality of feed passages 14 formed in the art of the nozzle 3 and leading directly to the thermal blast chamber, so that the open surface area is large.

The bottom of the groove defined by the housing 11 communicates with the divergent section 3" via an evacuation passage 10' within the thickness of the nozzle. The evacuation passage 10' providing communication between the housing 11 and the expansion space 15 defines a circular shape within the thickness of the nozzle 3 and following its shape. It is aligned with the valve 10 and downstream of its housing 11 so that it is opened or closed by the valve. Using an evacuation passage and a valve each defining a circular shape in the nozzle provides a flow circuit with a large cross section, suffering only low head losses. Thus a high gas flowrate can be evacuated to reduce the pressure and the temperature in the thermal blast chamber as quickly as possible when breaking high-current electrical arcs. In concrete terms, choosing a shape for the evacuation passage without corners and as curved as possible, like that shown in FIG. 1, achieves gas flow speeds approaching the speed of sound. The blast nozzle can be molded and include a lid capping the housing 11 on the same side as the thermal blast chamber, whilst allowing the valve to communicate with the chamber to evacuate the pressurized gas.

The evacuation passage 10' advantageously discharges into the divergent section 3" of the nozzle and thereby contributes to regeneration of the gas downstream of the throat 3' of the nozzle, which increases the dielectric strength of the gas between the arc contacts 1 and 2 during the dielectric breaking phase.

In a preferred embodiment of the circuit-breaker according to the invention, the nozzle 3 has an internal part 3B coaxial with an external part 3A. To be more specific, the external surface of one end of the internal part 3B has a flared overall shape. The largest diameter portion of this end is inserted into the casing 8, for example screwed into it, and its shape is substantially that of an annular flange in which the feed passages 14 are bored.

The external part 3A of the nozzle 3 has a cylindrical annular end with the same outside diameter as the annular flange of the internal part 3B, and is inserted into the casing 8, for example by screwing this annular end into it, until it bears against the annular flange of the internal part 3B. When the part 3A has been fitted around the part 3B, the part 3A surrounds the whole of the part 3B except for its annular flange.

The evacuation passage 10' and the housing 11 of the valve 10 are defined by a circular free space between the two parts. The nozzle 3 can be assembled by mounting the internal part 3B and then the external part 3A in the casing 8 before screwing on the permanent contact 6, which forms a ring around the casing 8 adapted to hold the two nozzle parts 3A and 3B in position relative to the casing 8. After fitting these two nozzle parts, a complementary nozzle part 3C aligned with the internal part 3B at the level of the divergent section 3" can be screwed or even glued to the internal part 3B to extend the evacuation passage 10' toward the expansion space 15.

In the embodiment shown in FIGS. 1 to 4, the piston compression chamber 5 communicates directly with the thermal blast chamber 4 through passages 9 with check valves 9', and the gases blown into the breaking space therefore comprise a mixture of cool gas coming from the piston compression chamber 5 and hot gas coming from the thermal blast chamber 4. With this arrangement, the temperature of the dielectric gas is reduced by the presence of the cool gas, which further increases the breaking capacity of the circuit-breaker according to the invention.

To increase still further the breaking capacity of the circuit-breaker according to the invention, the piston 5' of the compression chamber 5 can advantageously be mounted on a spring adapted to be compressed during the mobile contact opening displacement maneuver, so that it relaxes after displacement of the mobile contact. With this arrangement, the blast of dielectric gas produced by the piston compression chamber continues for a particular time period after the displacement of the mobile contact of the circuit-breaker ends, which further increases the breaking capacity of the circuit-breaker by extending the blast time.

There is claimed:

1. A circuit-breaker comprising:

two contacts disposed in a breaking space which is delimited by a blast nozzle and contains a dielectric gas;

a thermal blast chamber which communicates with said breaking space via a throat of said nozzle;

a valve adapted to open when pressure in said thermal blast chamber is above a particular threshold so as to evacuate pressurized gas from said thermal blast chamber; and an evacuation passage formed in said nozzle and in communication with said valve, said evacuation passage opening into an expansion space downstream of said breaking space relative to said throat, wherein said evacuation passage is adapted to be shut off by said valve.

2. The circuit-breaker claimed in claim 1, wherein a section of said nozzle widens to form a divergent section which partly delimits said expansion space downstream of said throat and said evacuation passage opens into said divergent section.

3. The circuit-breaker claimed in claim 1, wherein said nozzle comprises an external part coaxial with and surrounding an internal part to leave a circular free space forming the evacuation passage for evacuating gases from the thermal blast chamber.

4. The circuit-breaker claimed in claim 1, wherein said valve is incorporated into said nozzle, has an annular shape for shutting off the evacuation passage and is adapted to open against the action of at least one calibrated spring.

5. The circuit-breaker claimed in claim 1, including a piston pneumatic compression chamber that communicates with said thermal blast chamber.

6. A high-voltage electrical power supply network adapted to operate at a frequency less than or equal to 25 Hz comprising:

a circuit-breaker, said circuit breaker including, two contacts disposed in a breaking space which is delimited by a blast nozzle and contains a dielectric gas;

a thermal blast chamber which communicates with said breaking space via a throat of said nozzle;

a valve adapted to open when pressure in said thermal blast chamber is above a particular threshold so as to evacuate pressurized gas from said thermal blast chamber; and an evacuation passage formed in said nozzle and in communication with said valve, said evacuation passage opening into an expansion space downstream of said breaking space relative to said throat, wherein said evacuation passage is adapted to be shut off by said valve.

7. The circuit-breaker claimed in claim 1, wherein said evacuation passage defines a circular volume within the thickness of said nozzle and follows a general shape of said nozzle.

8. The circuit-breaker claimed in claim 1, wherein said thermal blast chamber is in communication with said expansion space via said evacuation passage.

9. The circuit-breaker claimed in claim 1, further including a divergent section downstream of said thermal blast area, said divergent section including said expansion space and formed so as to become wider in a direction of gas flow, wherein said expansion passage opens into said divergent section.

10. The circuit-breaker claimed in claim 9, wherein the gas evacuated through said valve mixes with gas which travels to said divergent section through said throat.

* * * * *